US009863147B2

(12) United States Patent
Graziano

(10) Patent No.: US 9,863,147 B2
(45) Date of Patent: Jan. 9, 2018

(54) CHANNEL AND CAP EXTRUSION SYSTEM

(71) Applicant: Paul Thaddeus Graziano, Fort Myers, FL (US)

(72) Inventor: Paul Thaddeus Graziano, Fort Myers, FL (US)

( * ) Notice: Subject to any disclaimer, the term of this patent is extended or adjusted under 35 U.S.C. 154(b) by 0 days.

(21) Appl. No.: 15/624,283

(22) Filed: Jun. 15, 2017

(65) Prior Publication Data

US 2017/0284097 A1 Oct. 5, 2017

Related U.S. Application Data

(62) Division of application No. 14/444,680, filed on Jul. 28, 2014, now abandoned.

(51) Int. Cl.

| | |
|---|---|
| ***E06B 1/52*** | (2006.01) |
| ***E04C 3/00*** | (2006.01) |
| ***E04B 2/76*** | (2006.01) |
| ***E04C 3/04*** | (2006.01) |
| ***E04C 3/28*** | (2006.01) |
| ***E06B 1/00*** | (2006.01) |

(52) U.S. Cl.

CPC ..... *E04C 3/00* (2013.01); *E04B 2/76* (2013.01); *E04B 2/767* (2013.01); *E04C 3/04* (2013.01); *E04C 3/28* (2013.01); *E06B 1/00* (2013.01); *E06B 1/528* (2013.01); *E04C 2003/0417* (2013.01); *E04C 2003/0439* (2013.01); *E04C 2003/0452* (2013.01); *E04C 2003/0465* (2013.01); *E04C 2003/0473* (2013.01)

(58) Field of Classification Search

CPC ..... E04C 3/06; E04C 2003/0452; E04C 2003/0439; E04C 2003/0413; E04C 2003/0465; E04C 2003/0473; E06B 1/528; E06B 3/16

USPC ..... 52/838, 839, 844, 845

See application file for complete search history.

(56) References Cited

U.S. PATENT DOCUMENTS

| | | | | | |
|---|---|---|---|---|---|
| 1,608,672 | A * | 11/1926 | Rappaport | E06B 3/16 | 138/166 |
| 3,332,197 | A * | 7/1967 | Hinkle | E04C 3/06 | 47/33 |
| 3,345,794 | A * | 10/1967 | Proud | E04B 2/18 | 52/204.62 |
| 3,398,499 | A * | 8/1968 | Moore | E06B 3/12 | 256/21 |
| 3,526,074 | A * | 9/1970 | Miller | E06B 1/18 | 52/204.591 |
| 3,698,149 | A * | 10/1972 | Baker | E04B 1/18 | 405/277 |

(Continued)

FOREIGN PATENT DOCUMENTS

FR 2129993 A2 * 11/1972 ..... E04B 2/7453

*Primary Examiner* — Robert Canfield

(74) *Attorney, Agent, or Firm* — Dunlap Bennett & Ludwig PLLC

(57) ABSTRACT

An extrusion profile and cap system is provided. The extrusion profile may be made of metals, polymers, ceramics, and the like. The extrusion profile may include an outer perimeter forming an internal cavity. At least one channel may be formed along the outer perimeter and protruding into the internal cavity. The cap is releasably attachable to the extrusion profile and may cover at least a portion of the channel. The cap may hide bolts, screws, angle bars, wires and the like within the channel.

4 Claims, 5 Drawing Sheets

(56) References Cited

U.S. PATENT DOCUMENTS

| | | | | |
|---|---|---|---|---|
| 4,438,614 | A * | 3/1984 | Raith | E04B 2/7401 52/481.2 |
| 6,405,504 | B1 * | 6/2002 | Richardson | E06B 1/36 52/211 |
| 6,484,360 | B1 * | 11/2002 | DeBartolo, Jr. | H02G 3/0487 16/95 R |
| 7,628,000 | B2 * | 12/2009 | Kahl | F16P 1/06 52/421 |
| 7,712,268 | B1 * | 5/2010 | Guthrie | E06B 5/003 52/202 |
| 7,877,962 | B2 * | 2/2011 | Teffenhart, Jr. | E04C 3/06 52/273 |
| 8,141,569 | B2 * | 3/2012 | Turner | B60S 3/04 134/123 |
| 8,756,900 | B1 * | 6/2014 | Hudson | E04C 3/07 52/844 |
| 9,546,486 | B2 * | 1/2017 | DesJardins, Jr. | E04F 19/02 |
| 2007/0266671 | A1 * | 11/2007 | Chromy | E04C 3/06 52/844 |
| 2008/0168738 | A1 * | 7/2008 | Shelton | E04C 3/06 52/650.1 |
| 2012/0110938 | A1 * | 5/2012 | DesJardins, Jr. | E04F 19/02 52/309.1 |

* cited by examiner

CHANNEL AND CAP EXTRUSION SYSTEM

CROSS-REFERENCE TO RELATED APPLICATION

This application is a divisional of U.S. non-provisional application Ser. No. 14/444,680, filed Jul. 28, 2014, the contents of which are herein incorporated by reference.

BACKGROUND OF THE INVENTION

The present invention relates to extrusion profiles and, more particularly, to extrusion profiles that hide fasteners, wires, and internal clips.

A typical screen, balcony or windowed enclosures made by extrusion profiles are riddled with exposed fasteners, external support clips, or angle clamps. The screws are unsightly and rust. In a typical balcony enclosure the screws may be internal only on the pickets (screws are still exposed on all other components). However, the process of internalizing the screws is laborious and the internal fasteners still rust and cause corrosion. Additionally, if the enclosures require electricity, the wires must be protected by a conduit that is typically externally mounted and unsightly.

As can be seen, there is a need for an extrusion profile that keeps, structural clips, angle clamps, wires and fasteners out of site, while facilitating the expedited construction of structures.

SUMMARY OF THE INVENTION

In one aspect of the present invention, an apparatus comprises: at least a first extrusion profile comprising an outer perimeter forming an internal cavity, wherein at least one channel if formed along the outer perimeter and protruding into the internal cavity; and a cap releasably attachable to the extrusion profile, wherein when the cap is attached to the extrusion profile, the cap covers at least a portion of the channel.

These and other features, aspects and advantages of the present invention will become better understood with reference to the following drawings, description and claims.

DETAILED DESCRIPTION OF THE INVENTION

Figure 1:
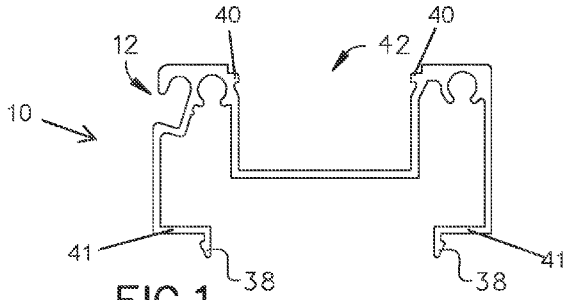
FIG. 1 is a profile view of a first embodiment of an extrusion profile of the present invention.
Figure 2:
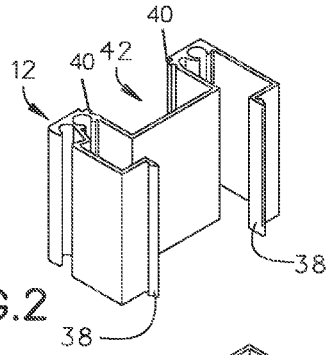
FIG. 2 is a perspective view of the extrusion profile of FIG. 1 demonstrated in extruded state of exemplary length.
Figure 3:
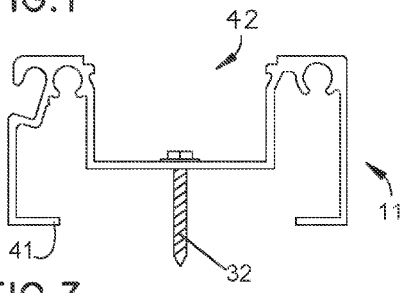
FIG. 3 is a profile view of a second embodiment of an extrusion profile of the present invention with a bolt running through the channel.
Figure 4:
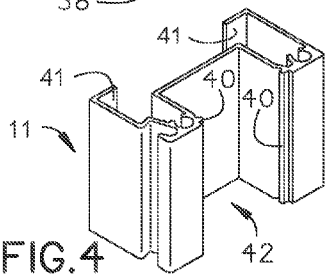
FIG. 4 is a perspective view of the extrusion profile of FIG. 3 demonstrated in extruded state of exemplary length.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The extrusion profiles of the present invention may be used to create structures, such as screen enclosure systems. The present invention utilizes a channel and cap system in which fasteners, structural angles or clips, and wires are hidden from site. The present invention provides a low cost solution to the issue of unsightly fasteners and provides for a quick installation of an integrated picket system, as well as complex enclosure systems found in swimming pool screen enclosures. While the present invention may be used for many different applications, the present invention may be used for front and rear porch screen enclosures, swimming pool screen enclosures, integrated picket balcony enclosure systems on second floor and above in two story residences, mid and hi-rise condominiums and apartments. The internal channel is an area whereby fasteners are hidden, pickets are inserted, clips are attached and electric wire can be hidden.

Referring to FIGS. 1 through 21, the present invention includes an extrusion profile 10. The extrusion profile 10 may be made of metals, polymers, ceramics, and the like. The extrusion profile 10 may include an outer perimeter forming an internal cavity. At least one channel 42 may be formed along the outer perimeter and protruding into the internal cavity. The present invention may further include a cap 30. The cap 30 is releasably attachable to the extrusion profile 10 and may cover at least a portion of the channel 42. The cap 30 may hide bolts 32, screws, angle bars 34, wires 46 and the like within the channel 42 or secure pickets in place within the channel 42.

The cap 30 may attach to the extrusion profile 10 in a verity of different ways. For example, the cap 30 may snap on and snap off of the extrusions profile 10, covering and revealing the channel 42 respectively. In certain embodiments, the outer perimeter may form an opening leading to the channel 42 at a first edge and a second edge. The first edge and the second edge may each include a protruding lip 40 that protrudes inwards towards the channel 42. The cap 30 of the present invention may include a clip 38, such as clip protrusions on either side. The clip 38 may be snapped into the channel 42 and hook onto the protruding lips 40, thereby securing the cap 30 to the extrusion profile 10.

In general, the extrusion profile 10 may include four sides including a first side, a second side, a third side and a fourth side. The extrusion profile 10 may be in multiple configurations. In certain embodiments, a first extrusion profile 11 and a tenth extrusion profile 28 may include a first channel 42 formed on the first side, and an opening into the internal cavity formed on the second side. The opening is formed by a first end ledge 41 and a second end ledge 41. A second extrusion profile 12 may include a channel 42 formed on the first side, and at least one opening into the internal cavity formed on the second side. The at least one opening is formed by a first end ledge 41 and a second end ledge 41. The first end ledge 41 and the second end ledge 41 of the second extrusion profile 12 may include a clip 38 formed to releasably secure to the first end ledge 41 and the second end ledge 41 of the first extrusion profile 11, thereby releasably attaching the first extrusion profile 11 and the second extrusion profile 12 as illustrated in FIGS. 19 through 22.

Figure 7:
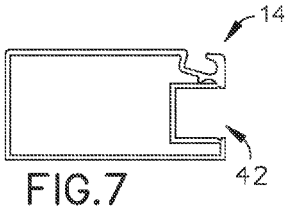
FIG. 7 is a profile view of a third embodiment of an extrusion profile of the present invention.
Figure 11:
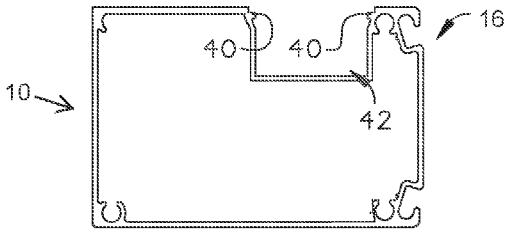
FIG. 11 is a profile view of a fourth embodiment of an extrusion profile of the present invention.
Figure 12:
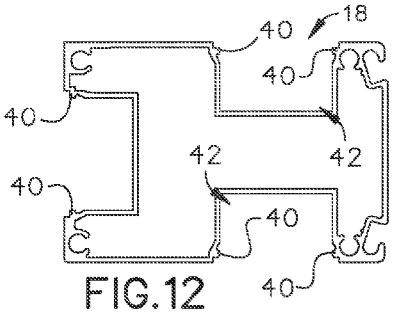
FIG. 12 is a profile view of a fifth embodiment of an extrusion profile of the present invention.
Figure 13:
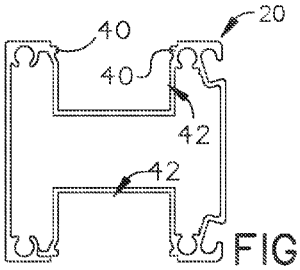
FIG. 13 is a profile view of a sixth embodiment of an extrusion profile of the present invention.
Figure 14:
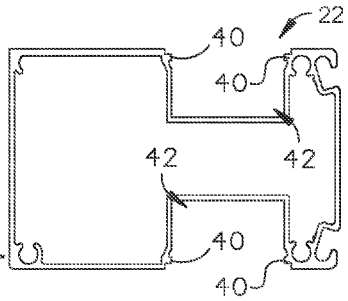
FIG. 14 is a profile view of a seventh embodiment of an extrusion profile of the present invention.
Figure 17:
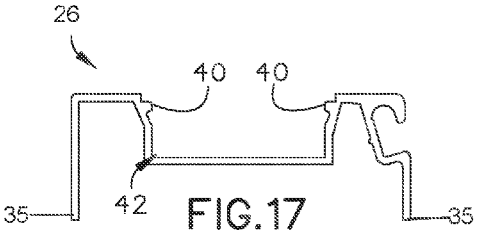
FIG. 17 is a profile view of a ninth embodiment of an extrusion profile of the present invention.
Figure 16:
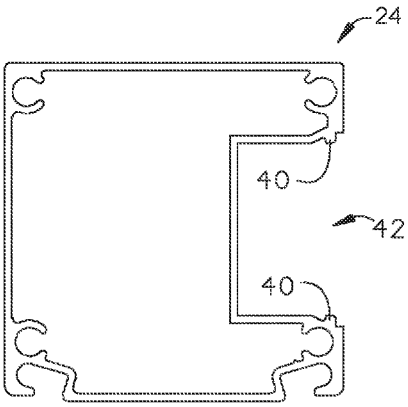
FIG. 16 is a profile view of an eighth embodiment of an extrusion profile of the present invention.
Figure 18:
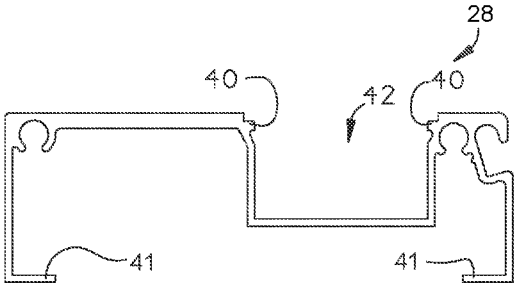
FIG. 18 is a profile view of a tenth embodiment of an extrusion profile of the present invention.
Figure 19:
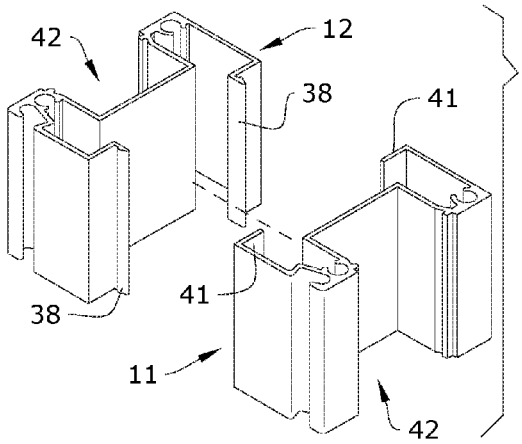
FIG. 19 is a perspective exploded view of the present invention demonstrating the assembly of two clipping components of two extrusion profiles.
Figure 20:
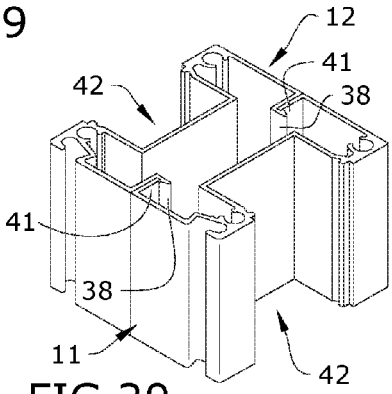
FIG. 20 is a perspective view of the present invention demonstrating a combination of two clipping components.
Figure 21:
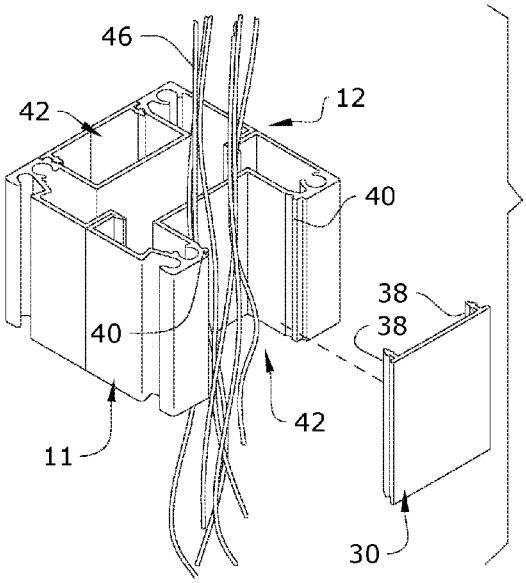
FIG. 21 is an exploded view demonstrating an attachment method of the cap to an extrusion profile as well as the inclusion of exemplary wires in the channel.
Figure 22:
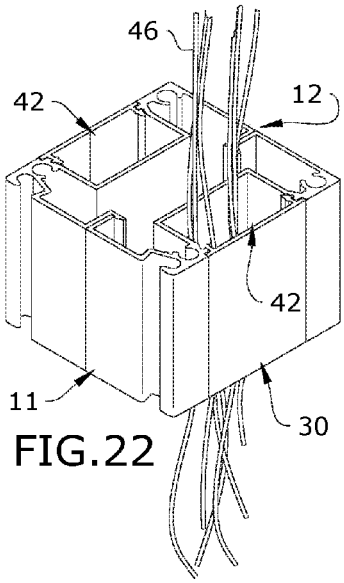
FIG. 22 is a perspective view of the invention demonstrating assembly of FIG. 21.
Figure 24:
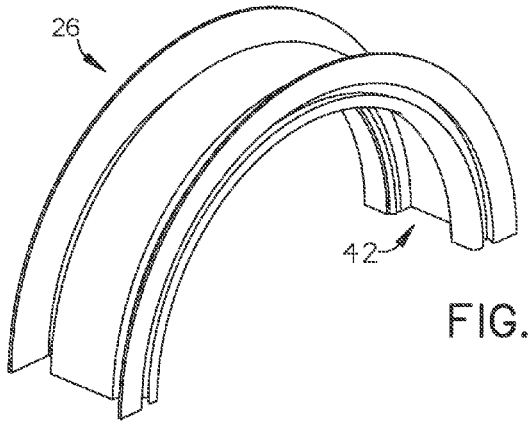
FIG. 24 is a perspective view of the extension profile of FIG. 17 bent in an arched shape.

As illustrated in FIGS. 7, 11, and 16, a third extrusion profile 14, a fourth extrusion profile 16, and an eight extrusion profile 24 may include a channel 42 on a first side, and sidewalls on the second side, third side, and fourth side. As illustrated in FIG. 12, a fifth extrusion profile 18 may include a first channel 42 on the first side, a second channel 42 on the second side, a third channel 42 on the third side, and sidewall on the fourth side. As illustrated in FIGS. 13 and 14, a sixth extrusion profile 20 and a seventh extrusion profile 22 may include channels 42 on the first side and second side, and a sidewall on the third side and the fourth side. As illustrated in FIG. 17, a ninth extrusion profile 26 may include at least one channel 42 formed on the first side, and on the second side having first end edge 35 and a second end edge 35, with an opening formed in between leading into the internal cavity. Such embodiments may have the second side removed forming the opening, and therefore may be more flexible, as illustrated in FIG. 24. The flexible arch may be used when arches need to be screened and is used in concert with many other extrusion profiles 10.

The extrusion profiles 10 and channels 42 of the present invention may include a variety of different dimensions. For exemplary purposes: the first extrusion profile 11 may include a channel 42 having a width×depth of 1×2 inch; the second extrusion profile 12 may include a 1×2 inch channel 42; the third extrusion profile 14 may be a 1×2 inch door main frame with a single channel 42; the fourth extrusion profile 16 may include a 2×3 inch extrusion with a single internal channel 42; the fifth extrusion profile 18 may be an extrusion beam that varies from a 2×4 inch to about a 2×10 inch and has three internal channels 42; the sixth extrusion profile 20 may be a 2×2 inch extrusion or larger with a double channel 42; the seventh extrusion profile 22 may include a 2×3 inch or 2×4 inch extrusion or larger with a double channel 42; the eighth extrusion profile 24 may be a 2×2 inch extrusion or larger with a single channel 42; the ninth extrusion profile 26 may include a 1×⅜ inch channel 42 that can be used as a flexible arch as well as a cap 30 to go over existing 1×2 inch, 2×2 inch, or 2×3 inch standard patio extrusions; and the tenth extrusion profile 28 may be 1×3 inch. However, as mentioned above, each variation of extrusion profiles 10 may include different dimensions. Each variation of extrusion profile 10 may be used together in a myriad of designs and may be aligned parallel or perpendicular to each other. Further, the channels 42 may vary in design, such as width and depth.

Figure 5:
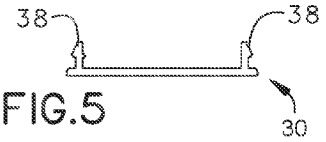
FIG. 5 is a profile view of a cap of a first embodiment of the present invention.
Figure 6:
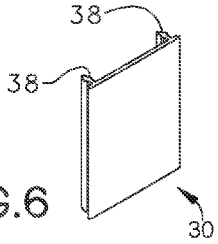
FIG. 6 is a perspective view of the cap of FIG. 5.
Figure 8:
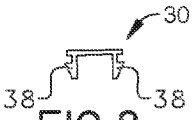
FIG. 8 is a profile view of a cap of a second embodiment of the present invention.
Figure 9:
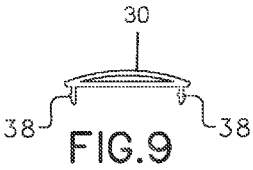
FIG. 9 is a profile view of a cap of a third embodiment of the present invention.
Figure 10:
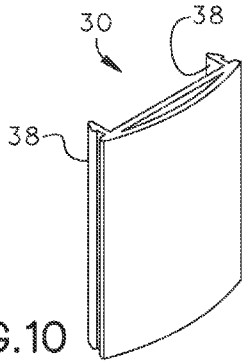
FIG. 10 is a perspective view of the cap of FIG. 9.
Figure 15:
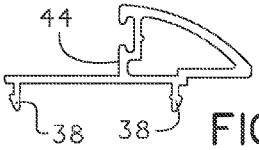
FIG. 15 is a profile view of a cap with a door stop.
Figure 23:
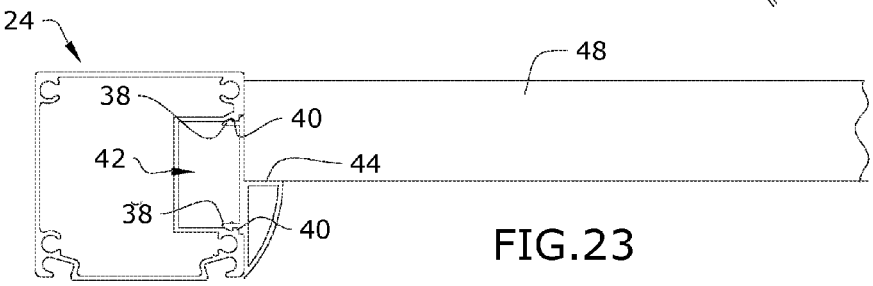
FIG. 23: is a profile view demonstrating assembly the extrusion profile of FIG. 16 in assembly with the cap of FIG. 15 illustrating a door resting against the door stop.
Figure 25:
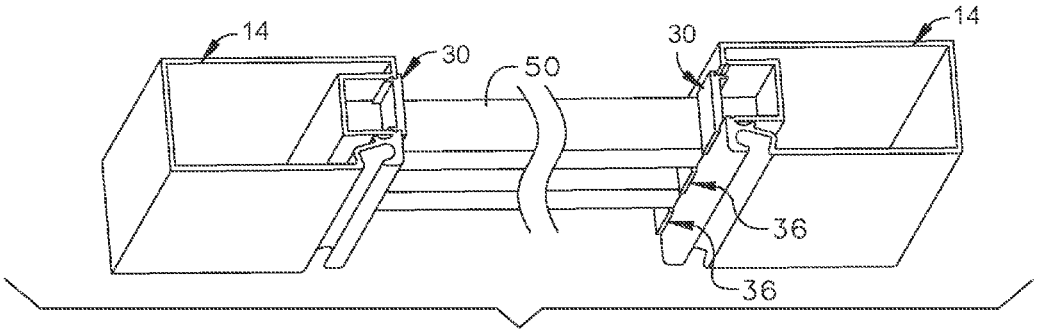
FIG. 25 is a perspective view demonstrating interface of extrusion profiles with caps and multiple pickets.
Figure 26:
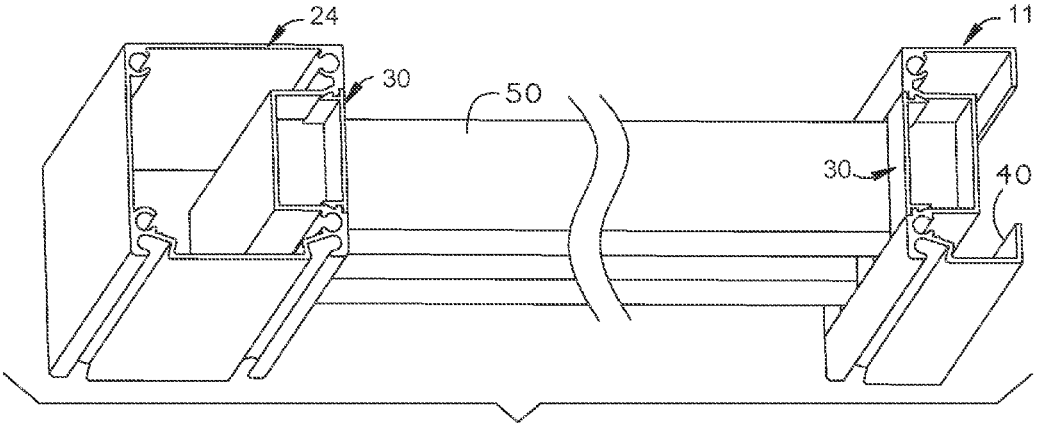
FIG. 26 is a perspective view demonstrating interface of extrusion profiles with caps and multiple pickets.

The present invention may further include multiple variations of caps 30. As mentioned above, the caps 30 may include a body portion having a first side and a second side, with clip protrusions protruding from the first side and the second side, forming a clip 38. As illustrated in FIGS. 5, 6 and 8, the body portion may be substantially flat. As illustrated in FIGS. 9 and 10, the body portion of the cap 30 may be curved. As illustrated in FIG. 25, the cap 30 may protrude passed the sidewalls of the extrusion profile 10. As illustrated in FIG. 26, the cap 30 may lie flush with the sidewalls of the extrusion profile 10. As illustrated in FIGS. 15 and 23, a door stop 44 may protrude from the body portion, and thereby prevent a door 48 from passing a certain point.

Figure 27:
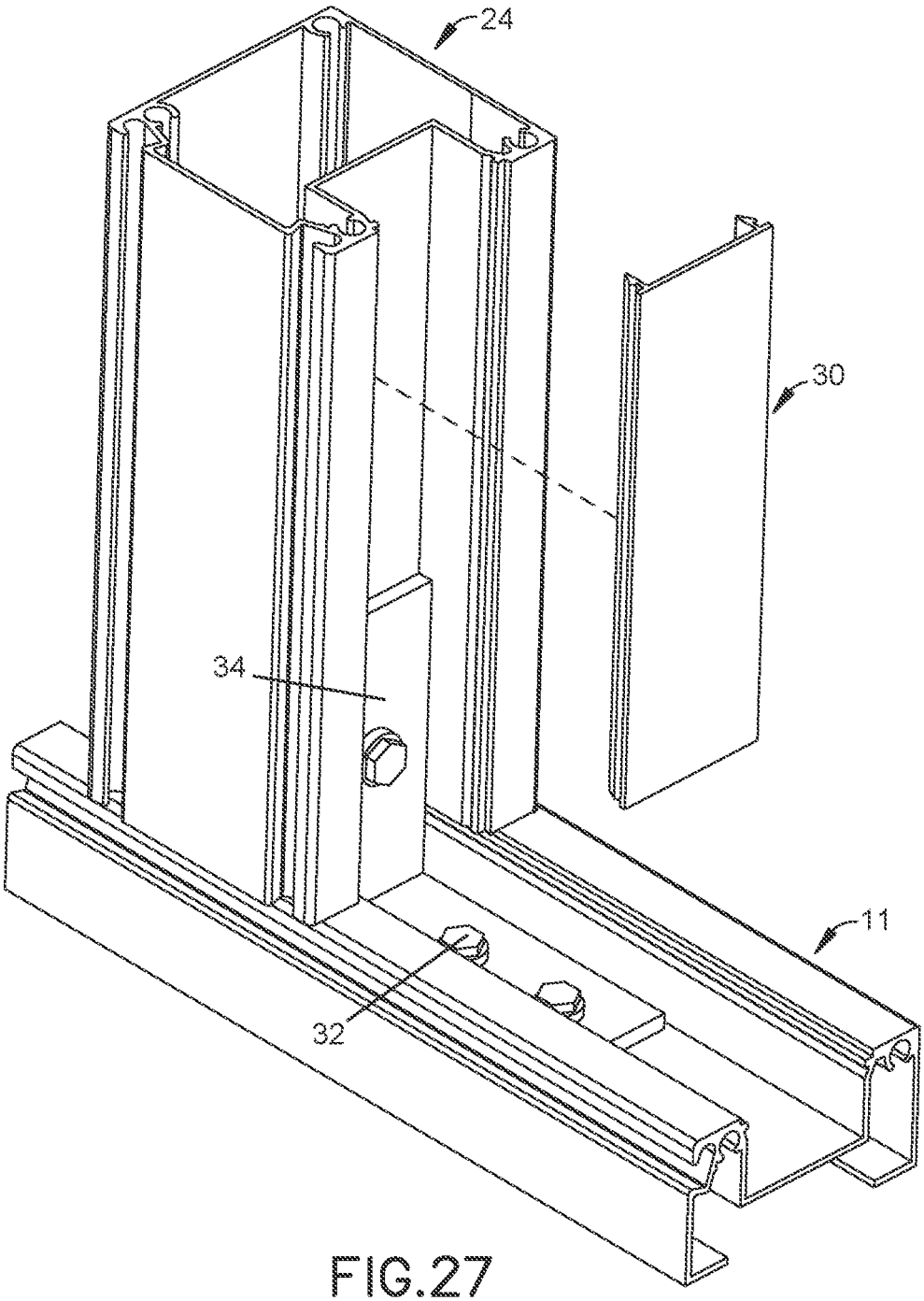
FIG. 27 is an exploded perspective view demonstrating more than one extrusion profile attached together and utilizing a cap to hide an exemplary angle plate and bolt.

As mentioned above, the extrusion profiles 10 of the present invention may be utilized together to create structures. As illustrated in FIG. 26, the eighth extrusion profile 24, the first extrusion profile 11 or a combination of any extrusion profiles 10 may be utilized to support a plurality of pickets 50. Each end of the pick 50 may rest within the channels 42 of the extrusion profiles 10. Caps 30 may be snapped into the channels 42 in between the pickets 50, creating a more uniformed layout, as well as securing the pickets 50 within the channels 42. As illustrated in FIG. 27, the first extrusion profile 11 may be attached to a surface by bolts 32. The eighth extrusion profile 24 may be attached to the first extrusion profile 11 in a perpendicular orientation by an angle clamp 34 and bolts 32. The cap 30 may be attached to the first and eighth extrusion profile 11, 24 covering the channels 42, and thereby covering the angle clamp 34 and the bolts 32. Using the caps 30 provides for a more uniform and cleaner layout to the structure as well as concealing fasteners, clips, wires and the like.

It should be understood, of course, that the foregoing relates to exemplary embodiments of the invention and that modifications may be made without departing from the spirit and scope of the invention as set forth in the following claims.

What is claimed is:

1. An apparatus comprising:

a first extrusion profile and a second extrusion profile each comprising an outer perimeter forming an internal cavity, wherein a channel is formed on a first side along the outer perimeter in between a first edge and a second edge, and protruding into the internal cavity, the first edge and the second edge each comprising a protruding lip protruding inwards towards one another, and at least one opening into the internal cavity is formed on a second side, wherein the at least one opening is formed by a first end ledge and a second end ledge, wherein the first end ledge and the second end ledge of the second extrusion profile comprises a clip releasably secured to the first end ledge and the second end ledge of the first extrusion profile; and at least one cap comprising a first end and a second end, the first end and the second end each comprising a clip protrusion protruding from an inner surface of the at least one cap, wherein the clip protrusions interlock with the protruding lips of one of the first extrusion profile and the second extrusion profile releasably attaching the at least one cap to the one of the first extrusion profile and the second extrusion profile and covering at least a portion of the channel.

2. The apparatus of claim 1, wherein the at least one cap comprises a first cap releasably attached to the first extrusion profile and a second cap releasably secured to the second extrusion profile.

3. The apparatus of claim 1, wherein the channels each comprise a rectangular cross section.

4. The apparatus of claim 1, wherein the at least one cap comprises an outer surface coplanar with the first side of the one of the first extrusion profile and the second extrusion profile.

* * * * *